US007386989B2

(12) United States Patent
Ryu et al.

(10) Patent No.: US 7,386,989 B2
(45) Date of Patent: Jun. 17, 2008

(54) AIR CONDITIONER

(75) Inventors: Sung Rok Ryu, Busan-si (KR); Byeong Jin Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 346 days.

(21) Appl. No.: 11/150,242

(22) Filed: Jun. 13, 2005

(65) Prior Publication Data

US 2005/0274134 A1 Dec. 15, 2005

(30) Foreign Application Priority Data

Jun. 14, 2004 (KR) ..... 10-2004-0043637

(51) Int. Cl.
*F25D 23/12* (2006.01)

(52) U.S. Cl. ..... 62/263; 62/428; 62/507

(58) Field of Classification Search ..... 62/262, 62/263, 259.4, 419, 426, 428–429, 507; 415/71, 415/72

See application file for complete search history.

(56) References Cited

U.S. PATENT DOCUMENTS 2,486,828 A * 11/1949 Dybvig ..... 62/262
3,943,728 A * 3/1976 Maudlin ..... 62/507
4,641,502 A * 2/1987 Aldrich et al. ..... 62/244
4,802,342 A * 2/1989 Gustafson et al. ..... 62/239
4,905,478 A * 3/1990 Matsuda et al. ..... 62/244
5,257,902 A * 11/1993 Atarashi et al. ..... 415/119

FOREIGN PATENT DOCUMENTS

CN 1250143 A 4/2000
CN 1451880 A 10/2003

* cited by examiner

*Primary Examiner*—William E Tapolcai
(74) *Attorney, Agent, or Firm*—Birch, Stewart, Kolasch & Birch, LLP

(57) ABSTRACT

An air conditioner is disclosed. The air conditioner includes a frame having air suction holes formed at upper and opposite lateral surfaces thereof and an air discharge hole formed at a front surface thereof, a heat exchanger having upper, left and right heat exchanger portions located along the air suction holes, and a fan disposed below the heat exchanger and adapted to suction air from radial and rearward directions thereof and to blow the air in a forward direction.

7 Claims, 9 Drawing Sheets

AIR CONDITIONER

This application claims the benefit of the Korean Patent Application No. P2004-043637, filed on Jun. 14, 2004, which is hereby incorporated by reference as if fully set forth herein.

BACKGROUND OF THE INVENTION

1. Field of the Invention

The present invention relates to an air conditioner, and more particularly, to an indoor unit of an air conditioner which is capable of more effectively blowing air.

2. Discussion of the Related Art

Generally speaking, an air conditioner is an apparatus that cools or heats an indoor space or purifies indoor air using phase variation of refrigerant depending on a thermodynamic cycle. Such an air conditioner comprises a compressor, condenser, expansion valve, and evaporator, and serves to provide a user with a more comfortable indoor environment. Generally, air conditioners are classified into a discrete-type air conditioner and an integral-type air conditioner.

The discrete-type air conditioner is configured such that an indoor unit and an outdoor unit are separately installed from each other while being connected via a refrigerant pipe. The integral-type air conditioner is configured such that an indoor unit and an outdoor unit are included in a single case, and is usually mounted in a window, etc.

In the integral-type air conditioner, it is important to effectively utilize the interior of the case because both the indoor unit and the outdoor unit are provided in a relatively small case. Further, to achieve more effective air conditioning of an indoor space, it is necessary to provide the case with air suction and discharge holes in consideration of the flow of fluid.

SUMMARY OF THE INVENTION

Accordingly, the present invention is directed to an air conditioner that substantially obviates one or more problems due to limitations and disadvantages of the related art.

An object of the present invention is to provide an air conditioner that is capable of more effectively blowing air.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an air conditioner comprises: a frame having air suction holes formed at upper and opposite lateral surfaces thereof and an air discharge hole formed at a front surface thereof; a heat exchanger having upper, left and right heat exchange portions located along the air suction holes; and a fan disposed below the heat exchanger and adapted to suction air from radial and rearward directions thereof and to blow the air in a forward direction.

The fan may include: a hub connected to a rotating shaft of a blow motor; and a plurality of blades arranged in a spiral direction along an outer circumference of the hub. The hub may have a cylindrical shape having a blocked flat front surface. Otherwise, the hub may have a conical shape having a blocked flat front surface.

The blades may include: a first blade inclined upward from a trailing end to a leading end thereof; and a second blade inclined downward from a trailing end to a leading end thereof. Discharge ends of the blades may be more protruded forward than the hub.

The left and right heat exchange portions may be curvedly bent from opposite sides of the upper heat exchange portion. The air conditioner may further comprise an orifice enclosing a discharge side of the fan.

In another aspect of the present invention, there is provided an air conditioner comprising: a frame internally defining an indoor unit region and an outdoor unit region and having air suction holes formed at upper and opposite lateral surfaces thereof; a barrier dividing the indoor unit region from the outdoor unit region; a blow motor mounted to the barrier; a heat exchanger having an upper heat exchange portion, and left and right heat exchange portions that are curvedly bent from opposite sides of the upper heat exchange portion, the left and right heat exchange portions and the upper heat exchange portion being located along the air suction holes; and a fan disposed below the heat exchanger and adapted to suction air via the air suction holes and to blow the air forward, the fan including a hub connected to a rotating shaft of the blow motor, and a plurality of blades arranged in a spiral direction along an outer circumference of the hub.

The hub may have a cylindrical shape having a blocked flat front surface. Otherwise, the hub may have a conical shape having a blocked flat front surface.

The blades may include: a first blade inclined upward from a trailing end to a leading end thereof; and a second blade inclined downward from a trailing end to a leading end thereof.

Discharge ends of the blades may be more protruded forward than the hub. The air conditioner may further comprise an orifice enclosing a discharge side of the fan.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Now, the preferred embodiments of the present invention will be explained in detail with reference to the accompanying drawings.

Figure 1:
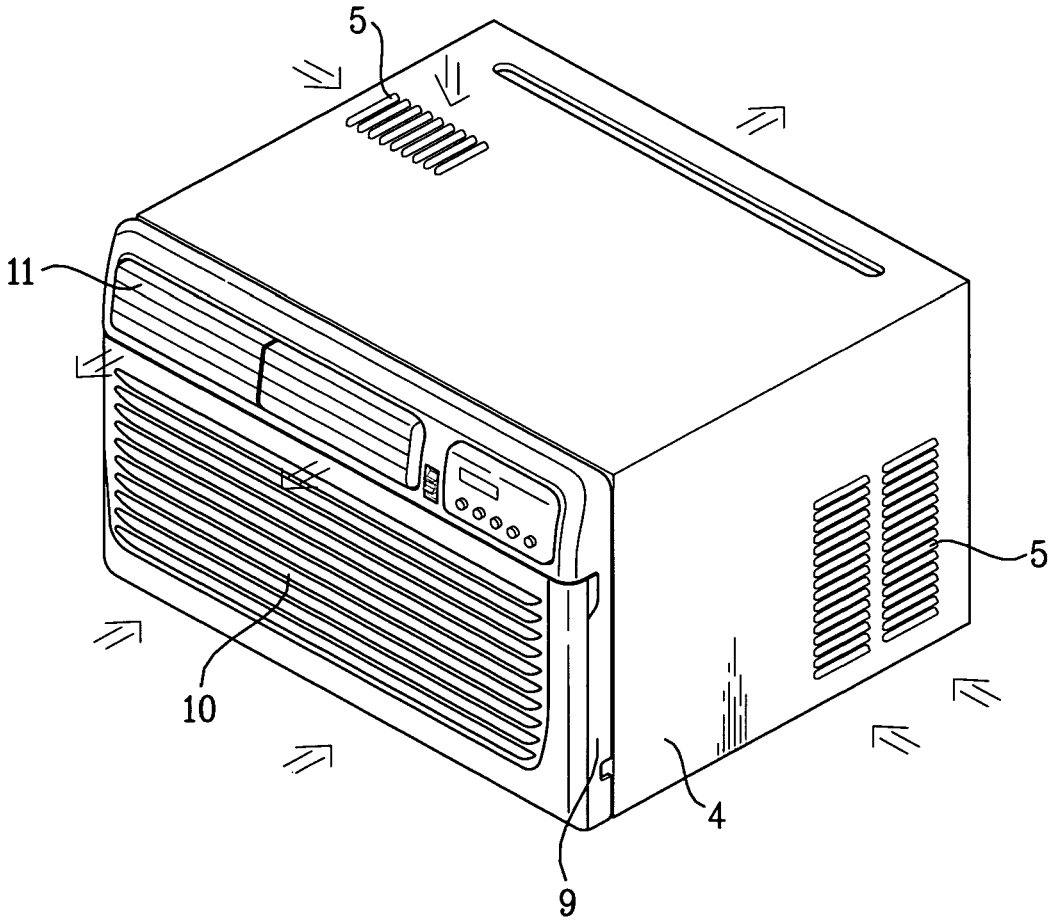
FIG. 1 is a perspective view of an air conditioner according to a first embodiment of the present invention.
Figure 2:
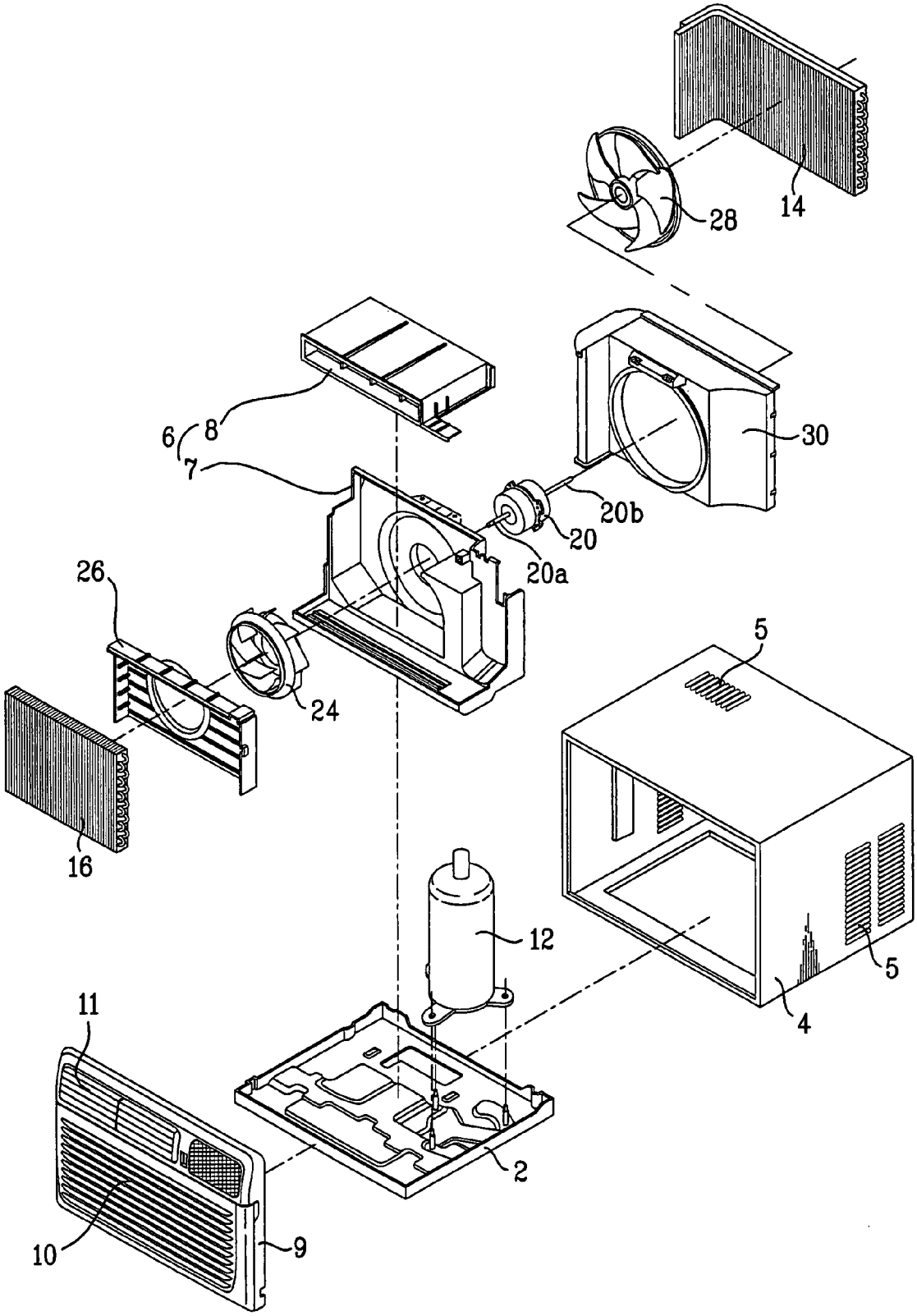
FIG. 2 is an exploded perspective view of the air conditioner according to the first embodiment of the present invention.
Figure 3:
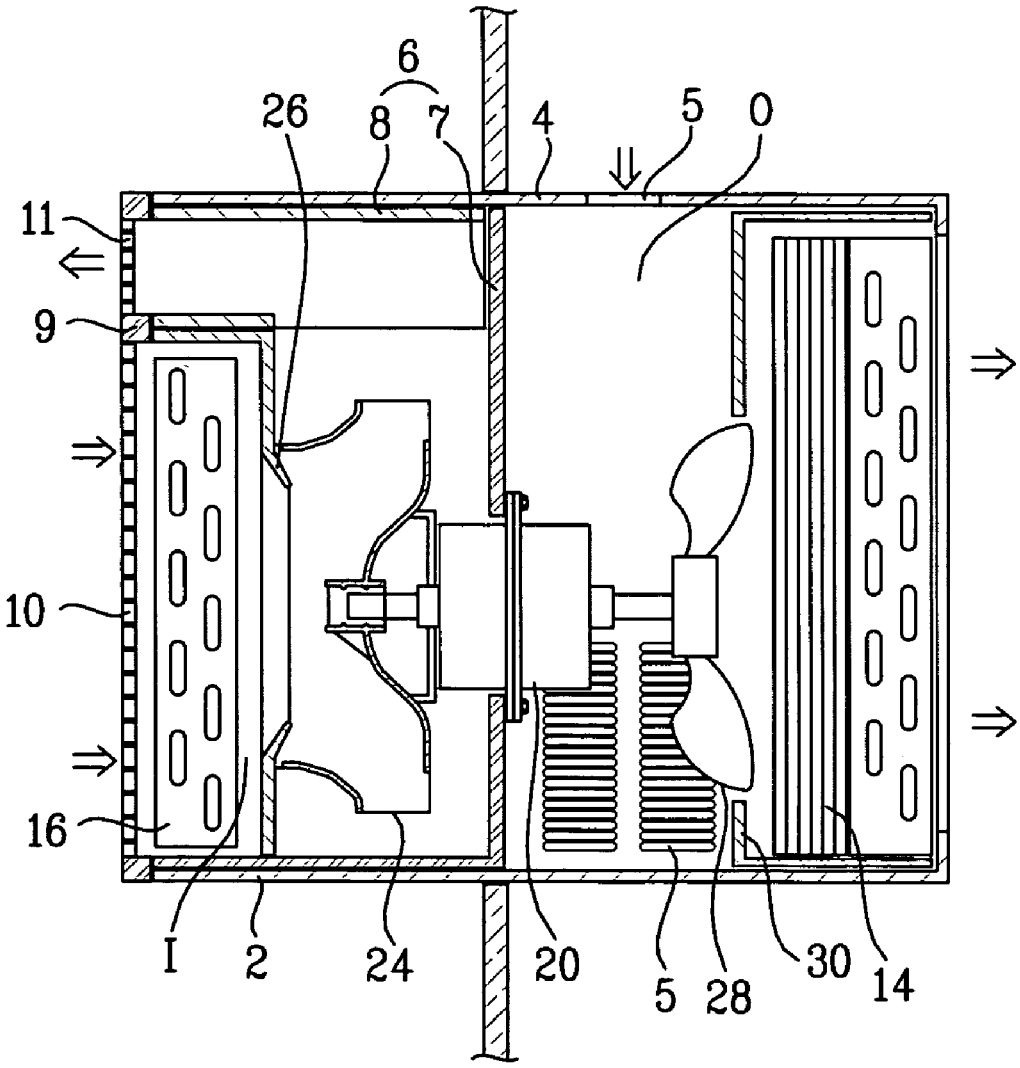
FIG. 3 is a longitudinal sectional view of the air conditioner according to the first embodiment of the present invention.

FIG. 1 is a perspective view of an air conditioner according to a first embodiment of the present invention. FIG. 2 is an exploded perspective view of the air conditioner. FIG. 3 is a longitudinal sectional view of the air conditioner.

As shown in FIGS. 1 to 3, the air conditioner according to the present embodiment includes a base pan 2, a cabinet 4, a partition unit 6, a front panel 9, a compressor 12, an indoor heat exchanger 16, and an outdoor heat exchanger 14. The compressor 12 is connected to the heat exchangers 14 and 16 via refrigerant pipes.

The base pan 2 is configured to cover a bottom side of the air conditioner. The cabinet 4 is located on the base pan 2 and defines the outer appearance of the air conditioner. A front side of the air conditioner is covered by the front panel 9. The partition unit 6 is located between the base pan 2 and the cabinet 4 to divide the interior of the cabinet 4 into an indoor unit region I and an outdoor unit region O.

The compressor 12 is located in the outdoor unit region O and is adapted to compress a low-temperature and low-pressure gaseous refrigerant into a high-temperature and high-pressure refrigerant. The refrigerant, discharged from the compressor 12, is introduced into the outdoor heat exchanger 14 to thereby be condensed via heat exchange with outside air. Next, the condensed high-temperature and high-pressure refrigerant is expanded to a low-temperature and low-pressure two-phase refrigerant while passing through an expansion valve (not shown). Here, the two-phase refrigerant means a mixture of liquid and gaseous refrigerants. After that, the expanded refrigerant is introduced into the indoor heat exchanger 16.

When the refrigerant is circulated in the above-described manner, the air conditioner operates to cool an indoor space. Otherwise, the refrigerant, discharged from the compressor 12, may be introduced into the indoor heat exchanger 16 to thereby cause the air conditioner to heat an indoor space. In this manner, the air conditioner may function as a heat pump that performs both heating and cooling operations.

The cabinet 4 has suction holes 5 formed at upper and lateral surfaces thereof exposed to the outside and a discharge hole (not shown) formed at a rear surface thereof.

Hereinafter, the suction and discharge of indoor air will be explained.

A suction hole 10 is formed at the front panel 9 in a lower portion of the front panel 9 to introduce indoor air into the cabinet 4. Also, a discharge hole 11 is formed at an upper side or lateral side of the suction hole 10 to discharge the indoor air from the cabinet 4.

The partition unit 6 includes a lower guide 7 disposed at an upper surface of the base pan 2, and an upper guide 8 on the lower guide 7. The upper guide 8 has a duct shape. With this configuration, the indoor air is introduced to a lower portion of the lower guide 7, and is guided to the discharge hole 11 in front of the lower guide 7.

To the partition unit 6 is mounted a dual shaft motor 20 having front and rear shafts 20*a* and 20*b*. The front shaft 20*a* of the dual shaft motor 20 protrudes into the indoor unit region I and is connected to a turbo fan 24. The rear shaft 20*b* of the dual shaft motor 20 protrudes into the outdoor unit region O and is connected to an axial fan 28.

An orifice 26 is mounted at a suction side of the turbo fan 24 and is adapted to increase the speed of blowing air. The axial fan 28 is enclosed around a rim thereof by a shroud 30 that forms an air path in the outdoor unit region O.

Now, the operation of the air conditioner according to the first embodiment of the present invention will be explained.

If the air conditioner is turned on, the refrigerant is circulated through the compressor 12, condenser 14, expansion unit (not shown), and indoor heat exchanger 16, thereby forming a refrigerating cycle. Also, the turbo fan 24 and the axial fan 28 are rotated as the dual shaft motor 20 is driven.

In this case, indoor air is suctioned by the turbo fan 24, and is subjected to air conditioning while passing through the indoor heat exchanger 16. After that, the indoor air successively passes through the orifice 26, lower guide 7, and upper guide 8, thereby being eventually discharged from a front upper portion of the air conditioner via the discharge hole 11 of the front panel 9.

Also, outside air is suctioned via the suction holes 5 of the cabinet 4 in accordance with rotation of the axial fan 28, and then, is subjected to air conditioning while passing through the shroud 30 and the outdoor heat exchanger 14, thereby being eventually discharged to the outside of a room.

In the case of the air conditioner according to the first embodiment of the present invention, as stated above, the indoor air is introduced from the front lower portion of the air conditioner and is discharged from the front upper portion thereof. This configuration tends to apply a relatively large load to the turbo fan 24 and increases the consumption of electricity. Further, the indoor heat exchanger 16 and the turbo fan 24 are arranged longitudinally, resulting in an increase in the longitudinal length of the air conditioner.

For this reason, the present invention provides a second embodiment showing a more improved structure, which will now be explained.

Figure 4:
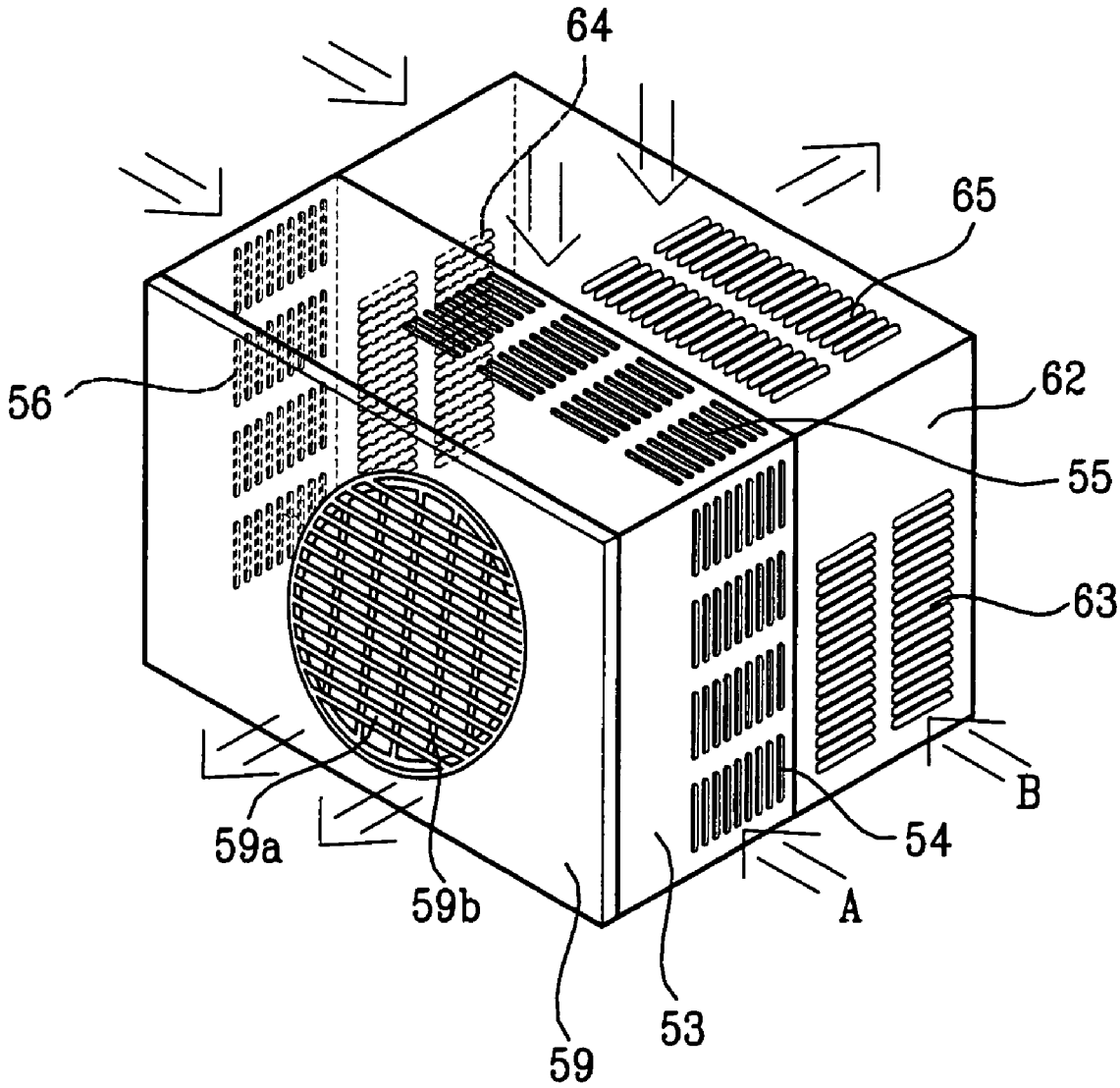
FIG. 4 is a perspective view of an air conditioner according to a second embodiment of the present invention.
Figure 5:
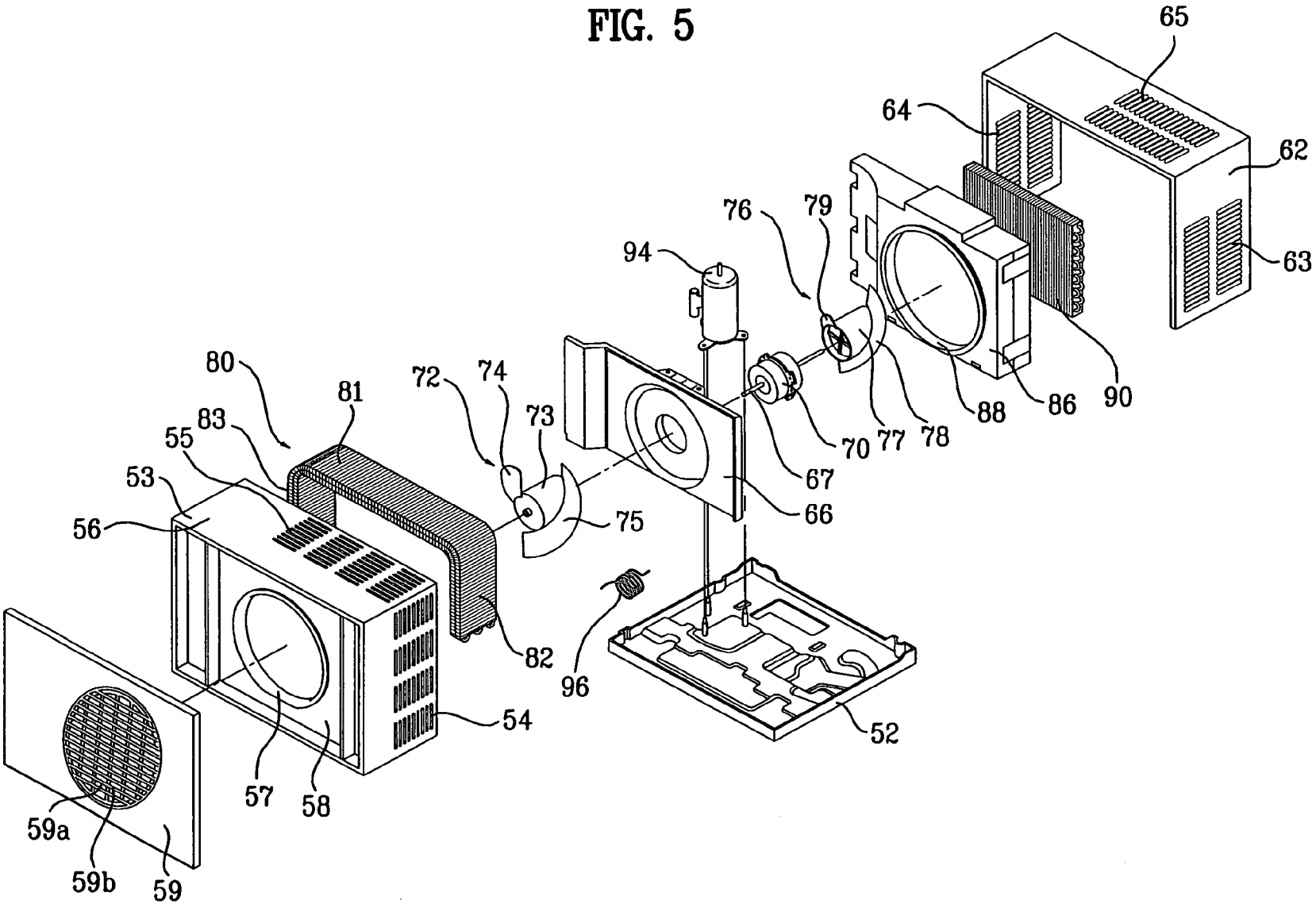
FIG. 5 is an exploded perspective view of the air conditioner according to the second embodiment of the present invention.

FIG. 4 is a perspective view of an air conditioner according to the second embodiment of the present invention. FIG. 5 is an exploded perspective view of the air conditioner.

As shown in FIGS. 4 and 5, the air conditioner according to the present embodiment is configured such that both the indoor unit and the outdoor unit are arranged together inside frames 53 and 62 that define the outer appearance of the air conditioner. Here, the frame 53 is an indoor frame that is formed at upper and opposite lateral surfaces thereof with indoor air suction holes and at a front surface thereof with an indoor air discharge hole. The frame 62 is an outdoor frame that is formed at upper and opposite lateral surfaces thereof with outside air suction holes and at a rear surface thereof with an outside air discharge hole.

With this configuration, indoor air A is introduced via the upper and opposite lateral surfaces of the indoor frame 53, and, then, is subjected to air conditioning. After that, the air is discharged via the front surface of the frame 53. Also, outside air B is introduced via the upper and opposite lateral surfaces of the outdoor frame 62, and, then, is subjected to heat exchange. After that, the outside air is discharged via the rear surface of the outdoor frame 62.

Specifically, a base pan 52 is provided at a bottom side of the air conditioner, and the indoor frame 53 is disposed on a front portion of the base pan 52. At the opposite lateral surfaces of the indoor frame 53 are formed left and right suction holes 54 and 56 and at the upper surface of the indoor frame 53 is formed an upper suction hole 55, so that the indoor air is introduced via the opposite lateral surfaces and upper surface of the indoor frame.

Inside the indoor frame 53 is provided an air guide 58. The air guide 58 has an orifice 57 that encloses an indoor fan 72. The orifice 57 is configured to enclose an outer circumference of the indoor fan 72 at a discharge side of the fan 72. The orifice 57 has a tapered cross section to increase the speed of blowing air.

Preferably, a front panel 59 is mounted at a front side of the indoor frame 53, and an air discharge hole 59*a* is formed at the front panel 59. Of course, the front panel 59 may form an integral part of the indoor frame 53. In this case, it can be said that the air discharge hole 59*a* is formed at the front surface of the indoor frame 53.

Preferably, a discharge grill 59*b* is fitted in the discharge hole 59*a* to guide the air, passed through the orifice 57, to be discharged straight forward.

The outdoor frame 62 is mounted on a rear portion of the base pan 52. Left and right suction holes 63 and 64 are formed at the opposite lateral surfaces of the outdoor frame 62, and an upper suction hole 65 is formed at the upper surface of the outdoor frame 62. A discharge hole is formed at the rear surface of the outdoor frame 62.

Here, the indoor and outdoor frames 53 and 62 may be formed integrally with each other.

Figure 6:
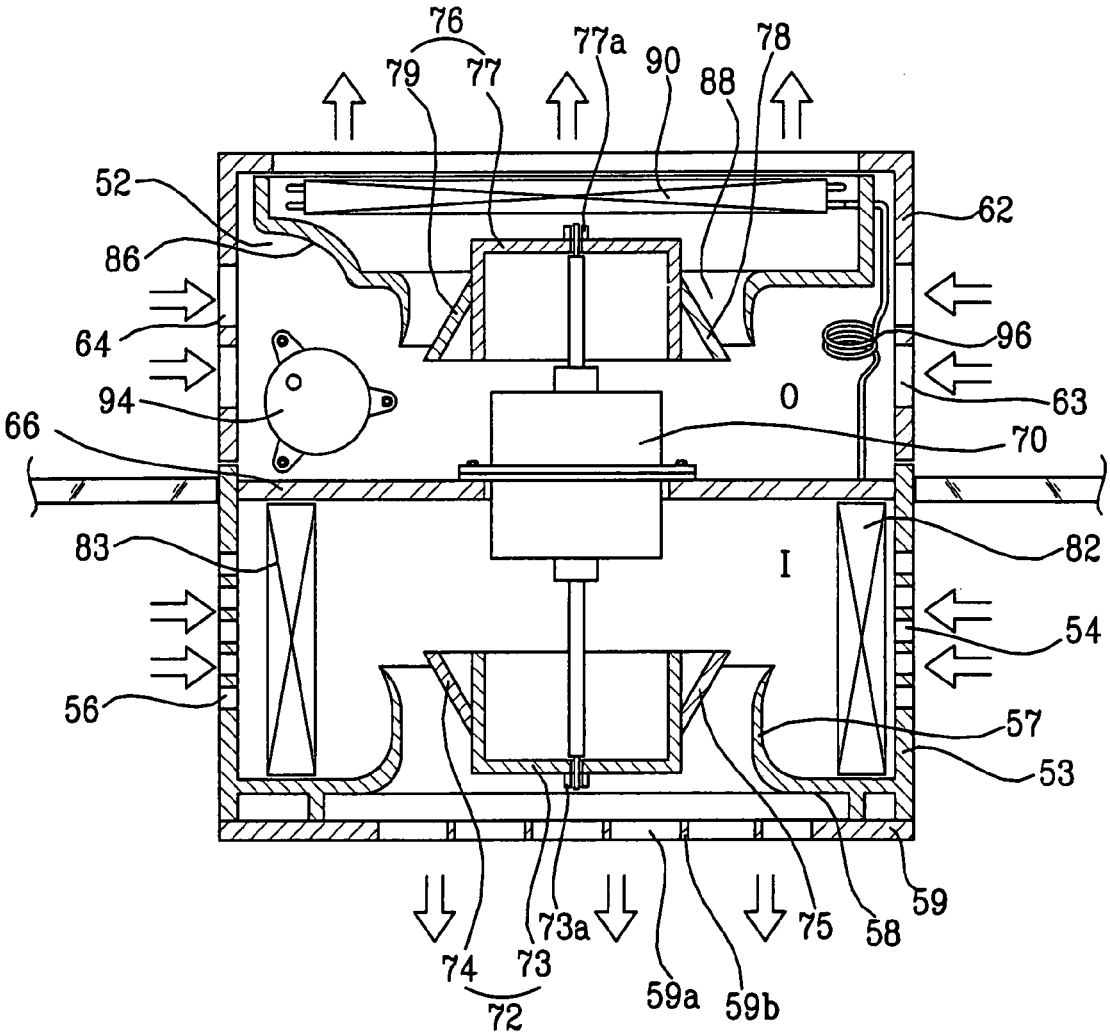
FIG. 6 is a cross sectional view of the air conditioner according to the second embodiment of the present invention.
Figure 7:
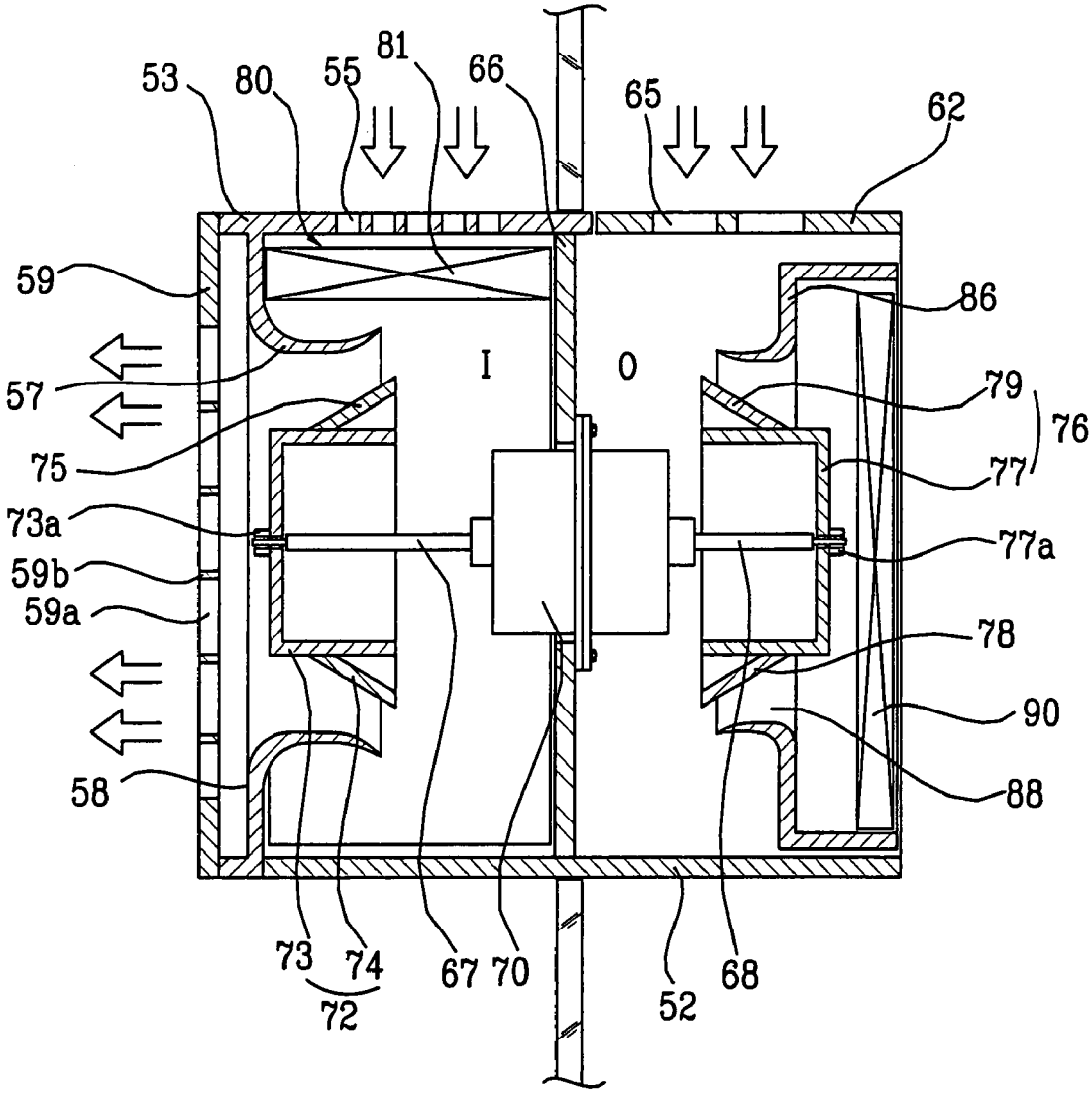
FIG. 7 is a longitudinal sectional view of the air conditioner according to the second embodiment of the present invention.

FIG. 6 is a cross sectional view of the air conditioner according to the second embodiment of the present invention. FIG. 7 is a longitudinal sectional view of the air conditioner.

As shown in FIGS. 6 and 7, a barrier 66 is disposed across the center of the base pan 52 to divide an interior space defined by the frames 53 and 62 into an indoor unit region I and an outdoor unit region O. A dual shaft motor 70 is mounted at a central portion of the barrier 66. The dual shaft motor 70 has a front rotating shaft 67 and a rear rotating shaft 68, which protrude forward and rearward, respectively.

An indoor fan 72 and an outdoor fan 76 are connected to the front and rear rotating shafts 67 and 68 of the dual shaft motor 70, respectively. With this configuration, when the indoor fan 72 is rotated, the indoor air is suctioned via the suction holes 54, 55 and 56, and then, is discharged via the discharge hole 59*a*. Also, when the outdoor fan 76 is rotated, the outside air is introduced via the suction holes 65, 65 and 65, and then, is discharged via the discharge hole.

Here, the indoor fan 72 is designed to suction the indoor air from around the indoor frame 53 and to blow it forward, and the outdoor fan 76 is designed to suction the outside air from around the outdoor frame 62 and to blow it rearward.

For this, preferably, the indoor fan 72 includes a hub 73, and a plurality of blades 74 and 75 arranged along an outer circumference of the hub 73. In the present embodiment, the hub 73 has a hollow cylindrical shape having an open rear surface. A fixing rib 73*a* is centrally formed at a front surface of the hub 73 so that the front rotating shaft 67 of the motor 70 is inserted and fixed in the fixing rib 73*a*.

The blades 74 and 75 are arranged in a spiral direction along the outer circumference of the hub 73. The fan, formed with the spiral blades, is referred to as a Kai-fan or X-fan. This kind of fan is designed to suction air from radial and rearward directions thereof and to discharge the air in the forward direction.

The plurality of blades 74 and 75 preferably include a first blade 74 that is inclined upward from a trailing end to a leading end thereof, and a second blade 75 that is inclined downward from a trailing end to a leading end thereof. The plurality of blades 74 and 75 are more protruded forward than the hub 73.

Preferably, the outdoor fan 76 is also a Kai-fan or X-fan. For this, the outdoor fan 76 includes a hub 77 fixed to the rear rotating shaft 68, and a plurality of blades 78 and 79 arranged in a spiral direction along an outer circumference of the hub 77. A fixing rib 77*a* is centrally formed at a rear side of the hub 77 so that the rear rotating shaft 68 is inserted and fixed in the fixing rib 77*a*. Other detailed configuration of the outdoor fan 76 is identical to that of the above-described indoor fan 72, and thus explanation thereof will be omitted.

Between the indoor frame 53 and the indoor fan 72 is arranged an indoor heat exchanger 80 for heat exchange of suctioned air. The indoor heat exchanger 80 is bent at left and right portions thereof to have an inverted U-shaped form. The inverted U-shaped indoor heat exchanger 80 includes an upper heat-exchange portion 81, and left and right heat-exchange portions 82 and 83. Here, the left and right heat-exchange portions 82 and 83 are curvedly bent from opposite sides of the upper heat-exchange portion 81.

Specifically, the upper heat-exchange portion 81 is located adjacent to the upper surface of the indoor frame 53, and the left and right heat-exchange portions 82 and 83 are located adjacent to the opposite lateral surfaces of the indoor frame 53. This allows the indoor heat exchanger 80 to effectively come into contact with indoor air, which is suctioned via the upper air suction hole 55 and the left and right air suction holes 54 and 56.

A shroud 86 is disposed inside the outdoor frame 62 and is adapted to form a path of outside air suctioned by the outdoor fan 76. An orifice 88 is formed at a central portion of the shroud 86. The outdoor fan 76 is located inside the orifice 88.

An outdoor heat exchanger 90 is disposed at a rear side of the shroud 86 for heat exchange with the outside air blown by the outdoor fan 76. The outdoor heat exchanger 90 has a rectangular box shape that is elongated in a transverse width direction.

A compressor 94 and a capillary tube 96 are provided in the outdoor unit region O. Here, the capillary tube 96 is refrigerant expansion means.

Now, the operation of the integral-type air conditioner according to the present invention configured as stated above will be explained.

If the integral-type air conditioner is turned on, high-temperature and high-pressure refrigerant, discharged from the compressor 94, is introduced into the outdoor heat exchanger 90 to be condensed while emitting heat to the surroundings. The condensed refrigerant is depressurized in the capillary tube 96, thereby being changed to a two-phase refrigerant. Next, the depressurized refrigerant is evaporated by absorbing heat from the surrounding while passing through the indoor heat exchanger 80. After that, the refrigerant is again circulated to the compressor 94.

In the integral-type air conditioner, the compressor 94 is operated in accordance with driving of the dual shaft motor 70. Simultaneously, the indoor fan 72 is rotated, allowing indoor air to be suctioned via the upper and opposite lateral surfaces of the indoor frame 53 to thereby pass through the indoor heat exchanger 80. Thereby, the suctioned air is subjected to heat exchange while passing through the upper heat-exchange portion 82 and the left and right heat-exchange portions 82 and 83.

The indoor air, suctioned by the indoor fan 72, is guided along the outer circumference of the hub 73 and the first and second blades 74 and 75, thereby forming a vortex. This allows the indoor air to be more effectively blown forward and to have an increased flow rate while passing through the orifice 57. After that, the indoor air is again discharged into an indoor space via the air discharge hole 59*a* of the front panel 59.

Meanwhile, when the outdoor fan 76 is rotated in accordance with driving of the dual shaft motor 70, outside air is suctioned via the opposite lateral surfaces and the upper surface of the outdoor frame 62. The suctioned air is guided along the outer circumference of the hub 77 and the first and second blades 78 and 79, thereby forming a rearward vortex.

The blown air passes through the orifice 88 of the shroud 86, thereby being subjected to heat exchange while passing through the outdoor heat exchanger 90. After that, the air is again discharged to the outside of a room via the rear surface of the outdoor frame 62.

Figure 8:
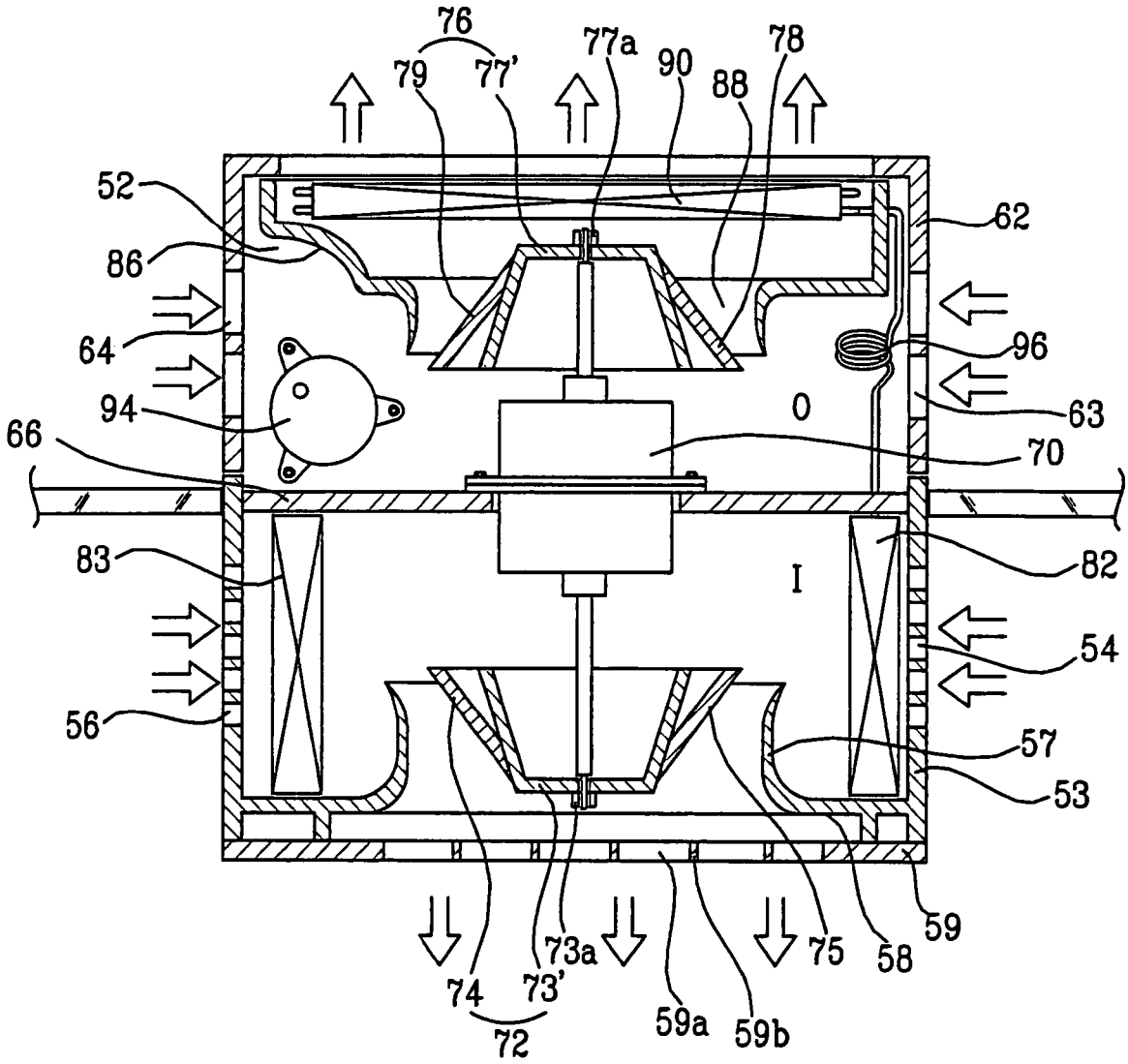
FIG. 8 is a cross sectional view of an air conditioner according to a third embodiment of the present invention.

FIG. 8 is a cross sectional view of an air conditioner according to a third embodiment of the present invention.

As shown in FIG. 8, the third embodiment differs from the second embodiment in that the hubs of the fans have a conical shape.

Specifically, a hub 73' of the indoor fan 72 has a hollow conical shape having a blocked flat front surface and an open rear surface. A hub 77' of the outdoor fan 76 also has a hollow conical shape having a blocked flat rear surface and an open front surface. The remaining configuration of the present embodiment except for the hubs 73' and 77' is identical to the second embodiment of the present invention, and thus the detailed explanation thereof will be omitted.

Figure 9:
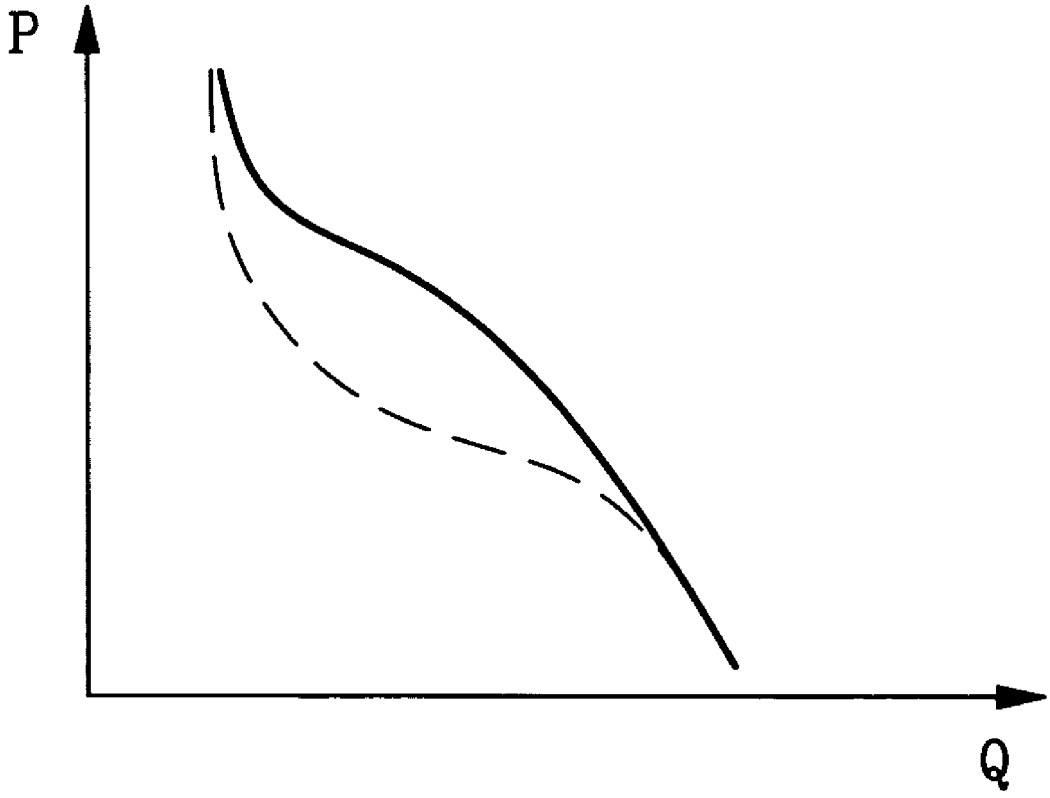
FIG. 9 is a graph illustrating blast pressures depending on different shapes of a hub of a fan used in the air conditioner according to the present invention.

FIG. 9 is a graph illustrating blast pressures depending on different shapes of the hub of the fan used in the air conditioner according to the present invention.

As shown in FIG. 9, in the case of the cylindrical hubs 73 and 77, as shown by a dashed line, the blast pressure P is first reduced rapidly and then is reduced gradually depending on the air flow Q. This means that the cylindrical hubs 73 and 77 exhibit an excessive deviation of wind speed. On the other hand, in the case of the conical hubs 73' and 77', as shown by a solid line, the blast pressure P is reduced gently depending on the air flow Q. This means that the conical hubs 73' and 77' exhibit a small deviation of wind speed. Therefore, it is desirable that the hub of the fan has a conical shape to achieve uniform wind blowing.

As apparent from the above description, the integral-type air conditioner according to the present invention has effects as follows.

Firstly, the fans of the present invention are designed to suction air from around frames of the air conditioner and to discharge the suctioned air forward or rearward. This has the effect of increasing an air suction area of the air conditioner, thereby enabling a large amount of air to be readily suctioned into the air conditioner while minimizing load applied to the fans and consumption of electricity.

Secondly, the indoor heat exchanger has a bent U-shaped form so that it is located adjacent to air suction holes formed at upper and opposite lateral surfaces of the frames. This has the effect of increasing a heat transfer area between indoor air and the indoor heat exchanger, and can achieve more effective heat transfer therebetween. As a result, the indoor air can be more readily cooled or heated, and the overall size of the integral-type air conditioner can be reduced.

Thirdly, the fan of the present invention is configured such that a plurality of blades is arranged in a spiral direction along an outer circumference of a hub thereof. This configuration enables the fan to suction air from radial and rearward directions thereof and to blow the suctioned air in a forward direction.

Fourthly, the plurality of blades include a first blade that is inclined upward from a trailing end to a leading end thereof, and a second blade that is inclined downward from a trailing end to a leading end thereof. These blades can diffuse blowing air forward in a whirlwind form to thereby allow the air to be discharged more far away.

Fifthly, because discharge ends thereof are more protruded forward than the hubs, the plurality of blades can guide the air straightly forward. This can reduce the generation of turbulence from the blowing air, resulting in a minimization of noise.

Sixthly, because the discharge side of the fan is enclosed by an orifice, the blowing air can be discharged with an increased flow rate.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An air conditioner comprising:

a frame internally defining an indoor unit region and an outdoor unit region and having an indoor frame and an outdoor frame, the indoor frame having air suction holes formed at upper and opposite lateral surfaces thereof and an air discharge hole formed at a front surface thereof;

a barrier dividing the indoor unit region from the outdoor unit region;

a blow motor mounted to the barrier;

an indoor heat exchanger located in the indoor unit region and having an upper heat exchange portion, and left and right heat exchange portions that are curvedly bent from opposite sides of the upper heat exchange portion, the left and right heat exchange portions and the upper heat exchange portion being located along the air suction holes;

an indoor fan disposed below the indoor heat exchanger and adapted to suck indoor air in an indoor room through the air suction holes and to blow the sucked indoor air forward into the indoor room, the fan including a hub connected to a rotating shaft of the blow motor, and a plurality of blades arranged in a spiral direction along an outer circumference of the hub;

an outdoor heat exchanger located in the outdoor unit region for exchanging heat with the indoor heat exchanger; and an outdoor fan located in the outdoor unit region for sucking an outdoor air through outdoor air suction holes at the upper and opposite lateral surfaces of the frame at the outdoor unit region.

2. The air conditioner as set forth in claim 1, wherein the hub has a cylindrical shape having a blocked flat front surface.

3. The air conditioner as set forth in claim 1, wherein the hub has a conical shape having a blocked flat front surface.

4. The air conditioner as set forth in claim 1, wherein the blades include:

a first blade inclined upward from a trailing end to a leading end thereof; and a second blade inclined downward from a trailing end to a leading end thereof.

5. The air conditioner as set forth in claim 1, wherein discharge ends of the blades are more protruded forward than the hub.

6. The air conditioner as set forth in claim 1, further comprising:

an orifice enclosing a discharge side of the fan.

7. The air conditioner as set forth in claim 1, wherein the sucked indoor air passes through the indoor heat exchanger before passing through the indoor fan.

* * * * *